US009625205B2

(12) United States Patent
Becke et al.

(10) Patent No.: US 9,625,205 B2
(45) Date of Patent: Apr. 18, 2017

(54) REFRIGERATION DEVICE HAVING AN ICE OR WATER DISPENSER

(71) Applicant: BSH HAUSGERAETE GMBH, Munich (DE)

(72) Inventors: Christoph Becke, Grosskarolinenfeld (DE); Max Eicher, Munich (DE); Swetlana Gorodezki, Munich (DE); Maike Kirschbaum, Munich (DE); Mathias Sigl, Herbrechtingen (DE); Ralph Staud, Munich (DE); Thomas Tischer, Haar (DE); Hans Peter Werner, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 98 days.

(21) Appl. No.: 14/428,430

(22) PCT Filed: Sep. 5, 2013

(86) PCT No.: PCT/EP2013/068357
§ 371 (c)(1),
(2) Date: Mar. 16, 2015

(87) PCT Pub. No.: WO2014/040903
PCT Pub. Date: Mar. 20, 2014

(65) Prior Publication Data

US 2015/0247667 A1 Sep. 3, 2015

(30) Foreign Application Priority Data

Sep. 14, 2012 (DE) ..... 10 2012 216 372

(51) Int. Cl.
*F25D 27/00* (2006.01)
*F25D 23/12* (2006.01)
*F25C 5/00* (2006.01)

(52) U.S. Cl.
CPC ..... *F25D 27/005* (2013.01); *F25C 5/005* (2013.01); *F25D 23/126* (2013.01); *F25D 27/00* (2013.01)

(58) Field of Classification Search
CPC ..... F25D 27/005; F25D 27/00; F25D 23/126; F25C 5/005
See application file for complete search history.

(56) References Cited

U.S. PATENT DOCUMENTS

2005/0044871 A1* 3/2005 Nowak ..... B67D 1/0875 62/264
2010/0319389 A1* 12/2010 Yang ..... F25D 23/126 62/389
2011/0174008 A1 7/2011 Kim
2011/0259719 A1 10/2011 Park

FOREIGN PATENT DOCUMENTS

CN 101517338 A 8/2009
CN 102128532 A 7/2011
CN 102395847 A 3/2012
EP 2383531 A2 11/2011
WO 2010119016 A2 10/2010

* cited by examiner

*Primary Examiner* — Emmanuel Duke
(74) *Attorney, Agent, or Firm* — Laurence A. Greenberg; Werner H. Stemer; Ralph E. Locher

(57) ABSTRACT

A refrigeration device includes an ice or water dispenser having an actuating lever. A light source is spaced apart in a light-emitting direction of the light source by an air gap from a light-coupling surface of the actuating lever.

12 Claims, 7 Drawing Sheets

REFRIGERATION DEVICE HAVING AN ICE OR WATER DISPENSER

BACKGROUND OF THE INVENTION

Field of the Invention

The invention relates to a refrigeration device with an ice dispenser or a water dispenser which has an actuating lever. The invention further relates to a refrigeration device ensemble, comprising two refrigeration devices, of which the first refrigeration device has an ice dispenser and the second refrigeration device has a water dispenser.

Refrigeration devices, especially refrigeration devices embodied as household appliances, are known and are used for household management in households or in the gastronomy field in order to store perishable foodstuffs and/or drinks at specific temperatures.

Such refrigeration devices are increasingly being provided with an ice dispenser for dispensing water ice cubes and/or crushed ice. Such refrigeration devices are additionally being provided with a water dispenser for dispensing chilled water. In order to enhance ease of operation, illumination of the actuating lever is also known. However this increases the effort involved in production.

BRIEF SUMMARY OF THE INVENTION

The underlying object of the invention is therefore to provide a refrigeration device or a refrigeration device ensemble in which the installation of the actuating lever or of the actuating levers is simplified.

These objects are achieved by the subject matter with the features according to the independent claims. Advantageous developments are the subject matter of the dependent claims, the description and also the drawings.

The present invention is based on the knowledge that an especially simple installation of the actuating lever or the actuating levers can be achieved when no installation of electrical lines is necessary.

In accordance with a first aspect the inventive object is achieved by a refrigeration device in which a light source is disposed, in the light-emitting direction of the light source, at a distance from a light-coupling surface of the actuating lever through an air gap. The technical advantage achieved by this is that the actuating lever can be embodied free from electrical components such as e.g. an LED and electrical lines to supply the LED with electrical energy. This simplifies production.

A refrigeration device is especially to be understood as a household appliance, i.e. a refrigeration device which is used for household management in households or in the gastronomy field, and is used in particular to store foodstuffs and/or drinks at specific temperatures, such as for example a refrigerator, a freezer, a fridge/freezer combination, a chest freezer or a wine cooler cabinet.

In an advantageous form of embodiment the light source is disposed at a fixed location. The technical advantage achieved by this is that an electrical line to supply the light source with electrical energy is not subjected to any deformation during an actuation of the actuating lever of the ice dispenser or the water dispenser, since the light source does not move along with the actuating lever. Thus a break in the electrical line as result of ageing through material fatigue is avoided and the life of the refrigeration device is increased.

In an advantageous form of embodiment the actuating lever is able to be hinged between a first position and a second position. The technical advantage achieved by this is that a first position is defined for an unactuated actuating lever and a second position is defined for an actuated actuating lever. This simplifies operation for a user, wherein through a hinging movement an actuation of the actuating lever by moving a vessel below an ice or water dispensing opening of the ice or water dispenser is possible.

In an advantageous form of embodiment the light-coupling surface is embodied such that in the first position and in the second position the degree of coupling-in of the light emitted by the light source is of equal size. The technical advantage achieved by this is that the luminosity of the emitted light is at the same level in both positions.

In an advantageous form of embodiment the light-coupling surface is a surface of a prism section of the actuating lever. The technical advantage achieved by this is that in the first position and in the second position of the actuating lever the degree of coupling-in of the light emitted by the light source is at the same level, so that for a user emitted light appears equally bright both in the first position and in the second position, since the prism section causes the light-coupling to be the same both in the first position and also in the second position.

In an advantageous form of embodiment the prism section and the actuating lever are embodied in one piece. The technical advantage achieved by this is that the actuating lever with the prism section can be produced in one working step, e.g. by injection molding. This simplifies production.

In an advantageous form of embodiment the prism section and the actuating lever are embodied uniform in terms of material. The technical advantage achieved by this is that coupled-in light does not experience any diffraction at a boundary surface of different materials.

In an advantageous form of embodiment the actuating lever has an edge which has at least two side surfaces, a lower connection section and an upper connection section, wherein the upper connection section is embodied as the light-coupling surface. The technical advantage achieved by this is that the actuating lever has an especially simple structure.

In an advantageous form of embodiment the prism section is embodied as a tapering section. The technical advantage achieved by this is that both in the first position and also in the second position of the actuating lever coupling-in of light is optimized. Thus undesired reflections at the light-coupling surface are minimized and the light yield is maximized.

In an advantageous form of embodiment the actuating lever has a light exit surface. The technical advantage achieved by this is that the actuating lever itself functions as a light source. Thus an especially optically attractive refrigeration device is provided.

In a further advantageous form of embodiment the light exit surface is an edge running around part of the circumference of the actuating lever. The technical advantage achieved by this is that for a user the contour of the actuating lever in particular is clearly accentuated. Thus operability is greatly enhanced.

In a further advantageous form of embodiment a curved section is provided in each case between the two side surfaces and the connecting section. The technical advantage achieved by this is that the light exit from the light exit surface is evened out since a light bundling at edges is avoided. The user thus gains an optically especially attractive impression.

In a further advantageous form of embodiment a front side and/or a rear side of the actuating lever are embodied as a total reflection surface. The technical advantage achieved by this is that no light, or by comparison with the light exit surface comparatively little light, exits from the total reflection surface. Thus only the light exit surface illuminates while the total reflection surface remains dark for a user by comparison with the light exit surface.

In a further advantageous form of embodiment a front side and/or a rear side of the actuating lever are embodied as light exit surface. The technical advantage achieved by this is that the light exit surface is enlarged even further.

In accordance with a second aspect the inventive object is achieved by a refrigeration device ensemble comprising two refrigeration devices, of which the first refrigeration device has an ice dispenser and the second refrigeration device has a water dispenser, wherein the first refrigeration device and/or the second refrigeration device has a light source which is disposed at a distance from the respective light source through an air gap. The technical advantage achieved by this is that the light distribution of the two actuating levers of the ice dispenser the water dispenser is evened out both for an actuated and also for an unactuated actuating lever. Thus the ice dispenser and the water dispenser are harmonized in their optical appearance perceptible for a user, so that a refrigeration device ensemble with the first refrigeration device with the ice dispenser and the second refrigeration device with the water dispenser has an optically attractive appearance.

BRIEF DESCRIPTION OF THE SEVERAL VIEWS OF THE DRAWING

Further exemplary embodiments are explained with reference to the enclosed drawings, in which.

DESCRIPTION OF THE INVENTION

Figure 1:
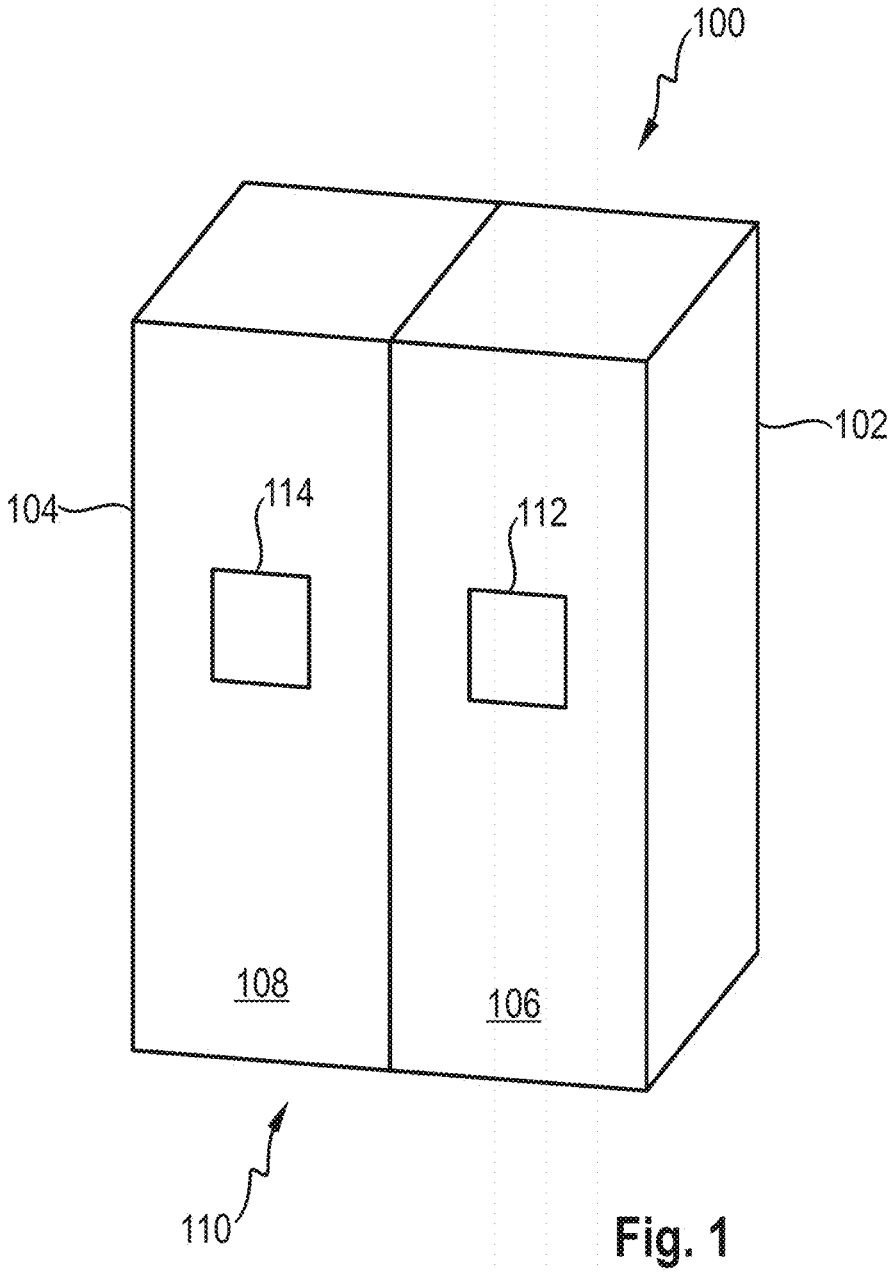
FIG. 1 shows a front view of a refrigeration device ensemble, comprising a first refrigeration device with an ice dispenser and a second refrigeration device with a water dispenser.

FIG. 1 shows two refrigeration cabinets as an exemplary embodiment for a first refrigeration device 102 and a second refrigeration device 104, which together form a refrigeration device ensemble 100. In the present exemplary embodiment the first refrigeration device 102 is embodied as a freezer cabinet and the second refrigeration device 104 as a refrigerator cabinet.

The first refrigeration device 102 has a freezer cabinet door 106 on its refrigeration device front side 110. By opening the freezer cabinet door 106 access can be gained to the interior of the first refrigeration device 102 in order to store frozen items therein or take them out. Disposed on the outer side, i.e. accessible with the freezer cabinet door 106 closed, is an ice dispenser 112. The ice dispenser 112 is embodied for dispensing water ice cubes and/or crushed ice.

Like the first refrigeration device 102, the second refrigeration device 104 has a refrigerator cabinet door 108 on its refrigeration device front side 110. By opening the refrigerator cabinet door 108, access can also be gained here to the interior of the second refrigeration device 104 in order to store refrigerated items therein or take them out. Disposed here on the outer side, i.e. accessible with the refrigerator cabinet door 108 closed, is a water dispenser 114. The water dispenser 114 is embodied for dispensing chilled, liquid water.

The two refrigeration devices 102, 104, for cooling frozen or refrigerated items, each have a coolant circuit with an evaporator (not shown), a compressor (not shown), a condenser (not shown) and a choke (not shown).

The evaporator is embodied as a heat exchanger, in which after expansion the liquid coolant is evaporated by taking up heat from the medium to be cooled, i.e. air inside the refrigerator cabinet.

The compressor is a mechanically-driven component which sucks coolant vapor from the evaporator and ejects it at a higher pressure to the condenser.

The condenser is embodied as a heat exchanger in which, after the compression, the evaporated coolant is condensed by emission of heat to an external cooling medium, i.e. the surrounding air.

The choke is an apparatus for constantly reducing the pressure by reducing the cross-section.

The coolant is a fluid which is used for transmission of heat in the refrigerating system, which at low temperatures and low pressure of the fluid takes up heat and at higher temperature and higher pressure of the fluid emits heat, wherein changes in the state of the fluid are usually involved.

Figure 2:
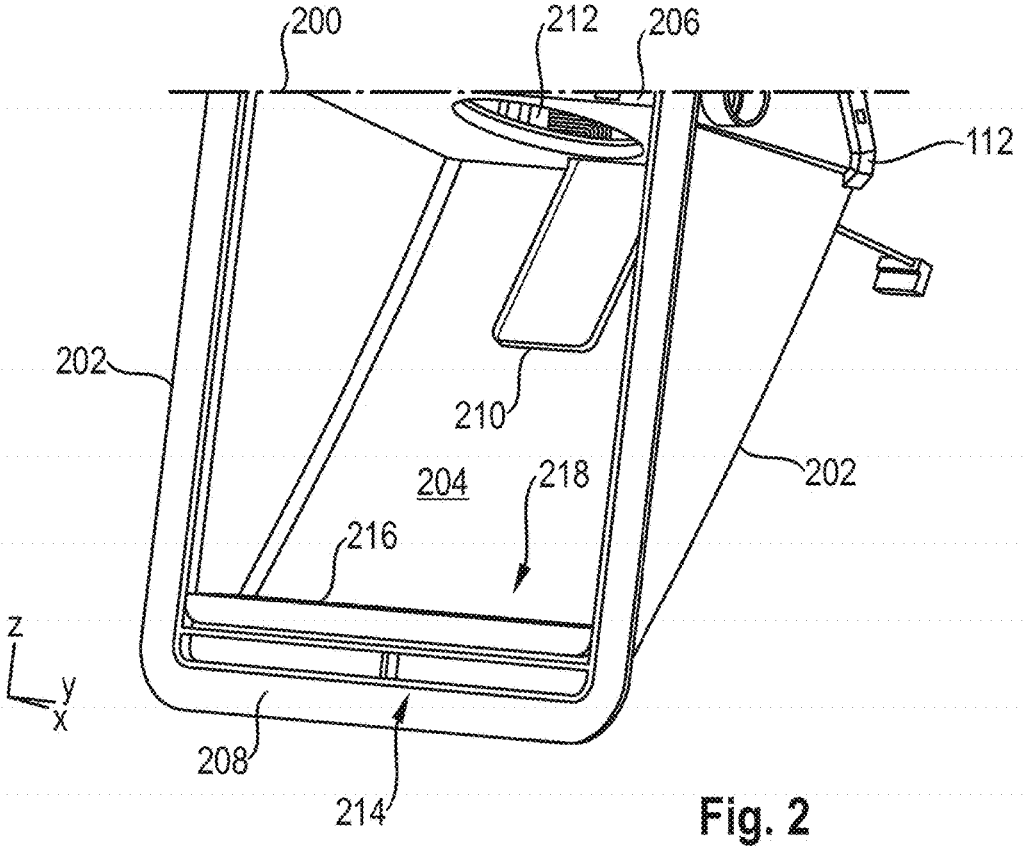
FIG. 2 shows a perspective diagram of the ice dispenser of FIG. 1.

FIG. 2 shows the ice dispenser 112. The ice dispenser 112 has an ice dispensing housing 200, which in the present exemplary embodiment has been made of plastic by means of injection molding. The ice dispensing housing 200 has two side walls 202 lying opposite one another, a rear wall 204, a roof 206 and a floor 208.

Disposed in the roof 206 is an ice dispensing opening 212, through which ice cubes and/or crushed ice can be dispensed. This process can be initiated by the actuation of an actuating lever 210 which is attached hingably to the roof 206 in the refrigeration device depth direction Y and actuates a micro switch (not shown) to which a controller of the ice dispenser 112 is connected for transmission of control signals in order to bring about the dispensing of ice cubes and/or crushed ice.

Disposed in the floor 208 is a collection dish 214 in which the melt water can collect. The collection dish 214 is covered by a cover 216 disposed above the collection dish 214 which can be taken off in order to clean the collection dish 214. The cover 206 is also made from plastic by means of injection molding in the present example.

In the present exemplary embodiment both the rear wall 204 and also the cover 216 are embodied as water guidance surfaces which guide melted water into the collection dish 214. In order to improve the water guidance and prevent the formation of flecks of water adversely affecting an attractive appearance, in the present exemplary example the rear wall 204 and the cover 206 are provided with a lotus covering. So that melted water can reach the collection dish a gap 218 is formed between the cover 216 and the rear wall 204.

Figure 3:
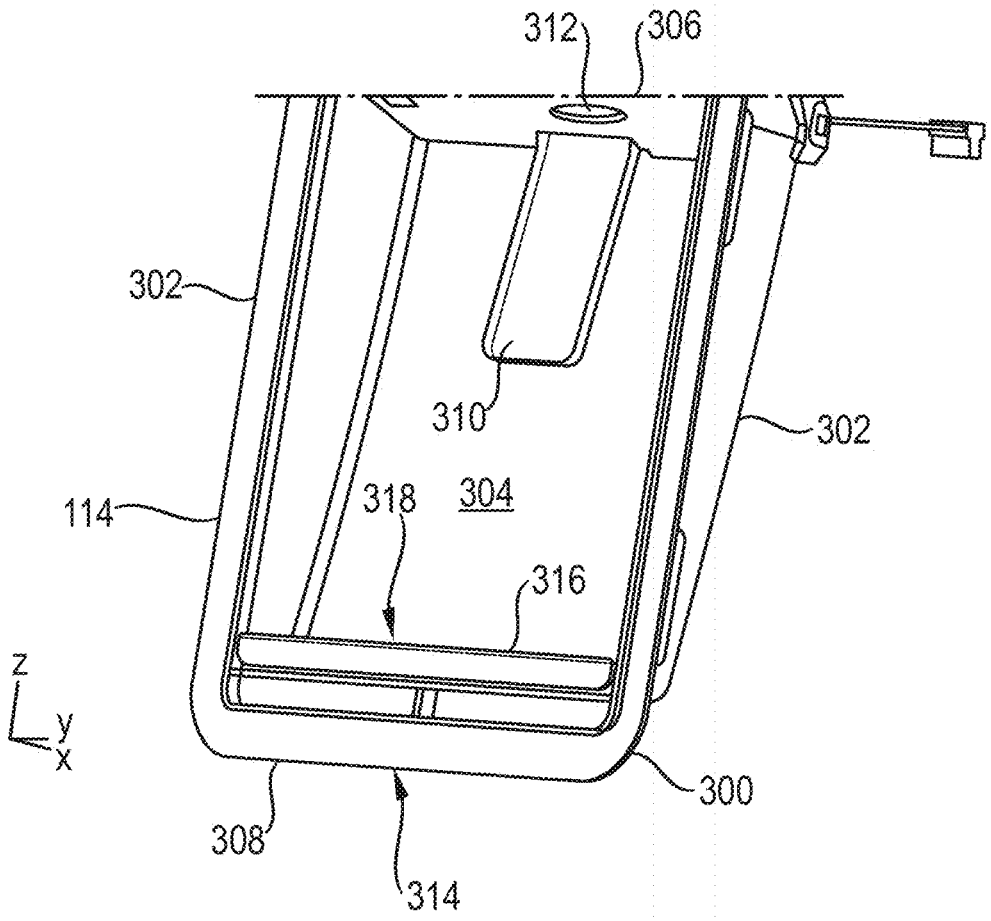
FIG. 3 shows a perspective diagram of the water dispenser of FIG. 1.

FIG. 3 by contrast shows a water dispenser 114. The water dispenser 114 has a water dispensing housing 300, which in the present exemplary embodiment has been made from plastic by injection molding. The water dispenser housing 300 has the same structure as the ice dispenser housing 200, thus having two side walls 302 opposite one another, a rear wall 304, a roof 306 and a floor 308. However the ice dispenser housing 200 does not extend as far in the refrigeration device depth direction Y as the water dispenser housing 300.

As with the ice dispenser 112, a water dispenser opening 312 is disposed in the water dispenser 114 in the roof 306, through which chilled, liquid water can be dispensed. This process to can be initiated by actuation of an actuating lever 310 which is attached hingably to the roof 306 in the refrigeration device depth direction Y and actuates a micro switch (not shown) to which a controller of the water dispenser 114 is connected for transmission of control signals in order to bring about the dispensing of chilled, liquid water. Thus the ice dispenser 112 and the water dispenser 114 have the same structure.

Just as in the ice dispenser 112, a collection dish 314 is provided in the water dispenser 114 in the floor 308, in which dripping water can collect. In this case in the present exemplary embodiment the collection dish 314 has the same dimensions, i.e. the same width in the refrigeration device width direction X, the same depth in the refrigeration device depth direction Y and the same height in the refrigeration device height direction Z. The collection dish 314 is likewise covered by a cover 316 disposed above the collection dish 314, which can be taken off in order to clean the collection dish 314. The cover 306 is also made of plastic by means of injection molding in the present exemplary embodiment. In this case in the present exemplary embodiment the cover 316 has the same structure and the same dimensions as the cover 216 belonging to the ice dispenser 112.

In the present exemplary embodiment both the rear wall 304 and also the cover 316 are embodied as water guidance surfaces which guide dripping water into the collection dish 314. The rear wall 304 and the cover 316 are also provided with a lotus coating in the present exemplary embodiment in order to improve the water guidance capability and to prevent the formation of flecks of water. So that dripping water can reach the collection dish 314, a gap 318 is again formed between the cover 316 and the rear wall 304.

Figure 4:
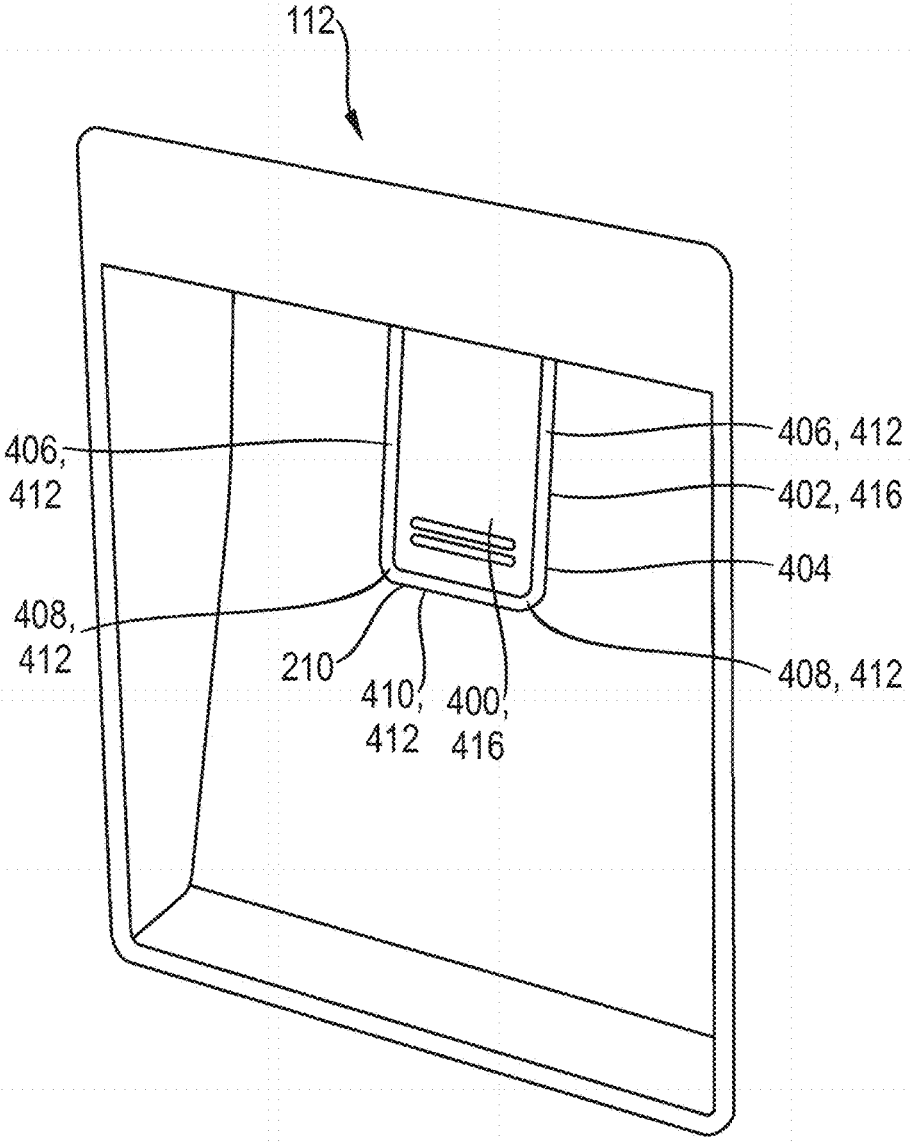
FIG. 4 shows a further perspective diagram of the water dispenser of FIG. 3, with an illuminated actuating lever.

FIG. 4 shows the actuating lever 210 of the ice dispenser 112. In the present exemplary embodiment the actuating lever 310 of the water dispenser 114 has the same structure as the actuating lever 210 of the ice dispenser 112, i.e. both are made of the same light-guiding material, in the present exemplary embodiment Plexiglas, and/or have the same dimensions. Therefore the information given below also applies in equal measure to the actuating lever 310 of the water dispenser 114.

The actuating lever 210, 310 has a front side 400 embodied flat, a rear side 402, lying opposite the front side 400, embodied flat and an edge 404 partly surrounding the actuating lever 210.

The edge 404 of the actuating lever 210, 310 has two side surfaces 406 lying opposite one another which are each adjoined by a curved section 408, wherein the curved sections 408 are in turn connected to one another by a lower connecting section 410 at the distal end of the actuating lever 210.

In the present exemplary embodiment the edge 404 of the actuating lever 210, 310 is embodied with its two side surfaces 406, the two curved sections 408 and the lower connecting section 410 as a light exit surface 412. When the light is coupled during operation from a light source (not shown in FIG. 4) into the actuating lever 210, e.g. after actuation of a selection button (not shown) of the water dispenser 114 by a user, the light exit is at the light exit surface 412 and thus causes an illumination of the actuating lever 210, 310 with the actuation element 210, 310 itself as light source, while the other sections, in the present exemplary embodiment the front side 400 and rear side 402, remain dark for a user compared to the light exit surface 412. To this end the front side 400 and the rear side 402 are embodied so that coupled-in light experiences a total reflection at said sides, i.e. they are embodied as total reflection surfaces 416.

By contrast the light exit surfaces 412 are embodied so that light coupled in at said surfaces is capable of exiting almost unhindered from the actuating lever 210. 310. To this end the light exit surface 412 has a different surface structure from the total reflection surfaces 416. In the present exemplary embodiment the light exit surface 412 differs from the total reflection surface 416 through its surface structure. The roughness of the surface structure of the light exit surface 412 is greater than the roughness of the total reflection surface 416. In the present exemplary embodiment the light exit surface 412 is embodied as a frosted surface and is embodied for output of diffuse light.

In order to increase the light exit surface 412 the edge 404 is embodied higher, i.e. the thickness of the actuating lever 210, 310 in the area between the front side 400 and the rear side 402 is (in the refrigeration device depth direction Y) smaller than in the area of the edge 404. Thus the light exit surface 412 in the refrigeration device depth direction Y is increased by the widened edge 404 and a user is given an optically more spacious impression or a 3D effect.

The two curved sections 408 are embodied rounded in the present exemplary embodiment, i.e. they connect the side surfaces 406 with the lower connection section 410 through a section embodied free of edges. Through this the light exit from the light exit surface 412 is evened out, since a light bundling is avoided at the edges. Thus an optically especially attractive impression is produced for a user.

In the present exemplary embodiment the actuating lever 210, 310 also has a symbol 414, which shows to a user a preferred point of contact on the front side 400 of the actuating lever 210, 310. The symbol 414 is printed in the present exemplary embodiment on the rear side 402 of the actuating lever 210, 310. This means that the symbol 414 cannot be touched by a user touching the front side 404 of the actuating lever. Furthermore with this arrangement of the symbol 414 on the rear side 402 of the actuating lever 210 there is no resulting wear on the printed symbol 414, and by this arrangement an impression of depth is created for the user.

Figure 5:
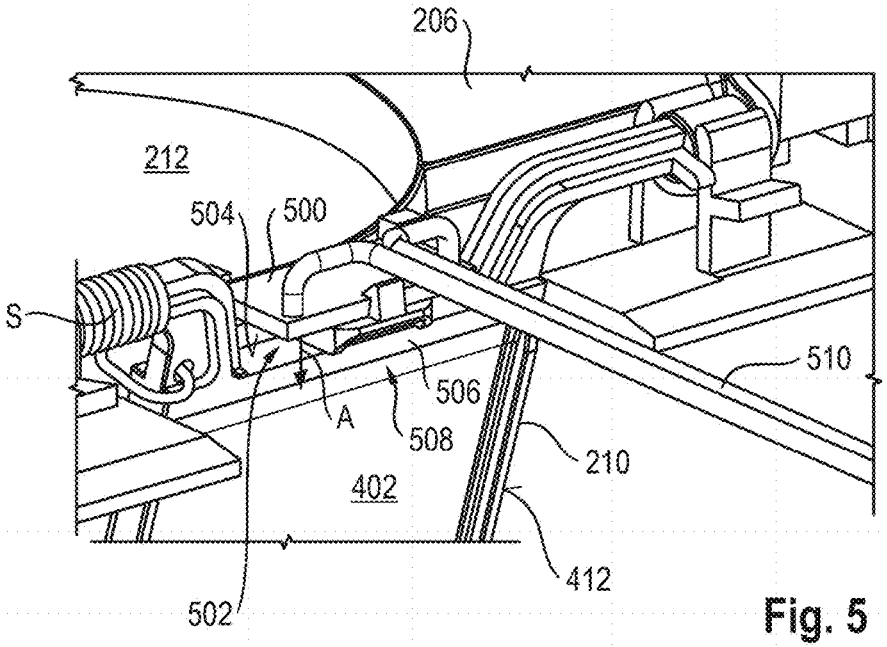
FIG. 5 shows a perspective diagram of the coupling of light into the actuating lever.
Figure 6:
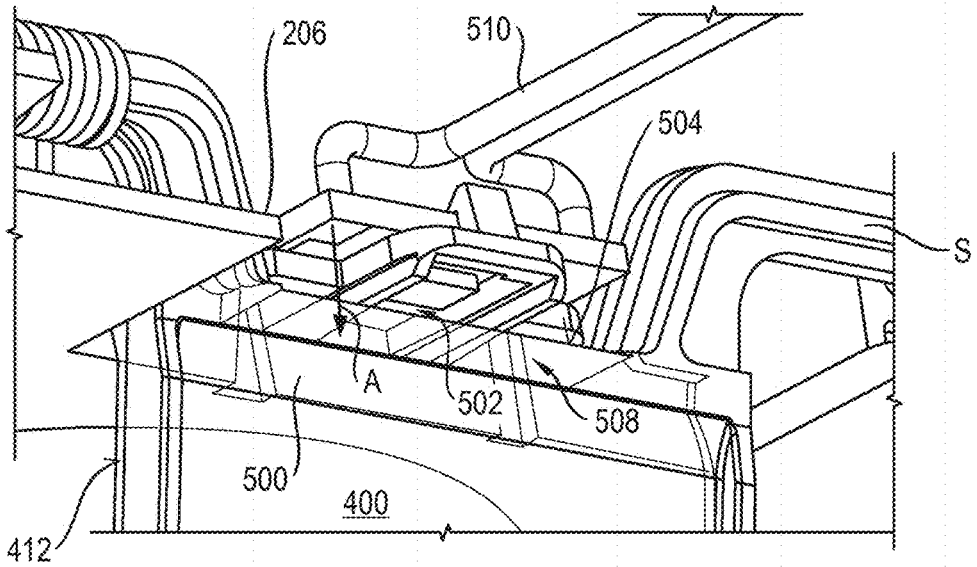
FIG. 6 shows a further perspective diagram of the coupling of light into the actuating lever.
Figure 7:
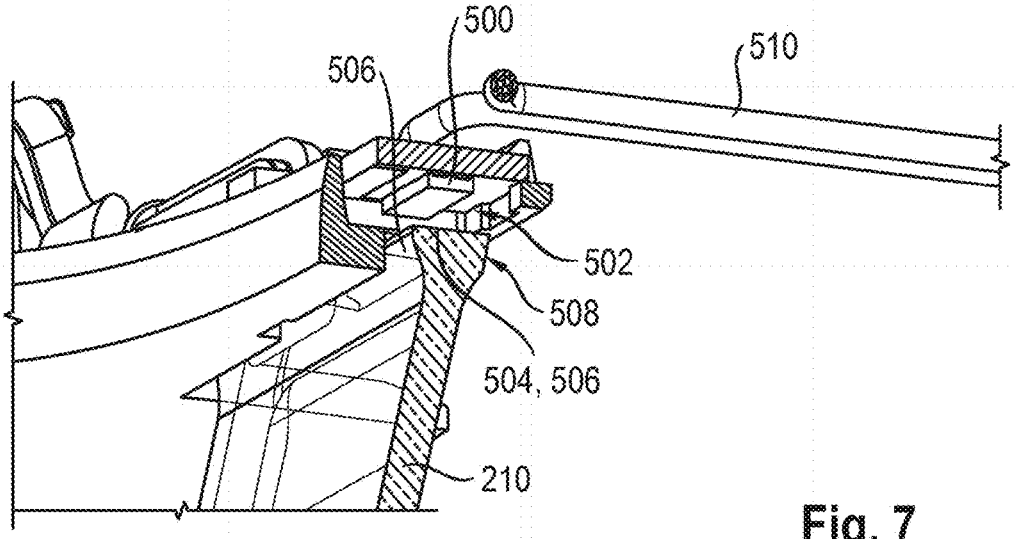
FIG. 7 shows a cross-sectional diagram through FIG. 5.

FIGS. 5 to 7 show the arrangement of a light source 500 for coupling light into the actuating lever 210.

In the present exemplary embodiment an LED is used as light source 500. The light source 500 is disposed in a fixed location. To this end it is attached to the roof 206 of the ice dispenser housing 200, e.g. by means of a latching connection. An electrical line 510 is provided to supply power to the light source 500.

The light emitted by light source 500 is emitted in light-emitting direction A. After passing through an air gap 502, by which the light source 500 and the actuating lever 210 are disposed at a distance from one another, the light strikes a light-coupling surface 504. The light-coupling surface 504 has a surface avoiding light reflections in order to maximize the degree of coupling-in of the light emitted by the light source 500.

In the present exemplary embodiment the light-coupling surface 504 is disposed in the upper connection section 506 of the actuating lever 210, which like the lower connection section 410, connects the two side surfaces 406 of the actuating lever 210 to one another.

The actuating lever 210 is embodied in the present exemplary embodiment in its connection section 506 in the form of a prism so that it has a prism section 508. In the present exemplary embodiment the prism section 508 and the actuating lever 210 are embodied in one piece and in a uniform material. E.g. the actuating lever 210 with the prism section 508 is made of Plexiglas or another light-conducting plastic.

In the area of the light-coupling surface 504 the actuating lever 210 is embodied wider in the refrigeration device depth direction Y than in the area between the front side 400 and the rear side 402. It is thus embodied tapering and this taper is in the light-emitting direction A.

The prism section 508 extends in the present exemplary embodiment in the refrigeration device width direction X. Accordingly the light-coupling surface 504 of the prism section 508 extends in both the refrigeration device width direction X and also in the refrigeration device depth direction Y. It thus has a rectangular shape in the present exemplary embodiment.

A normal vector at right angles to the light-coupling surface 504 of the prism section 508 is in the present exemplary embodiment at right angles to the hinge axis S around which the actuating lever 210, 310 is able to be hinged.

Figure 8:
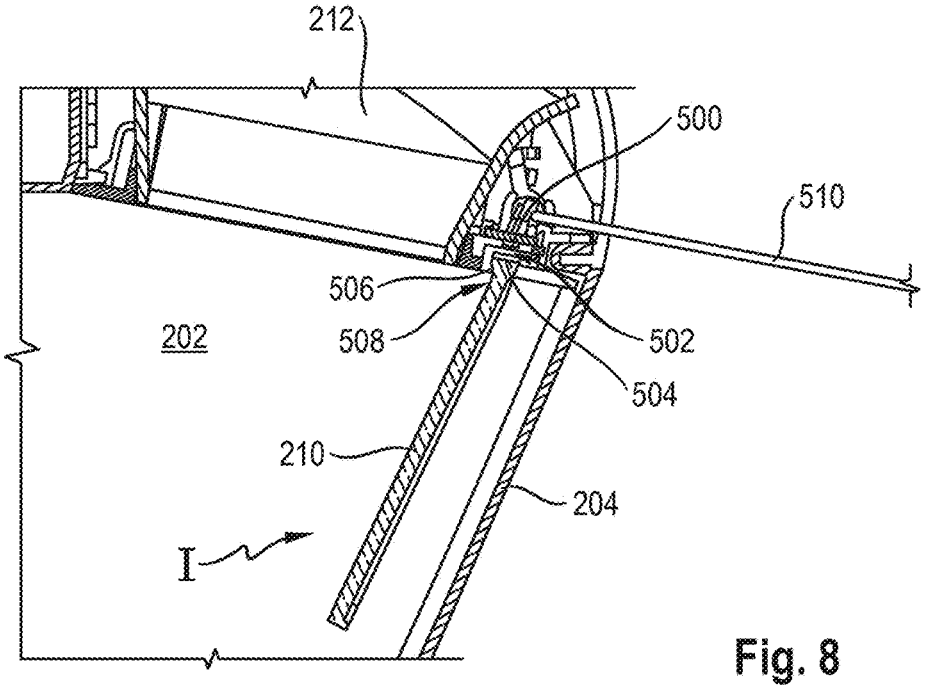
FIG. 8 shows a cross-sectional diagram with an actuating lever in a first position.
Figure 9:
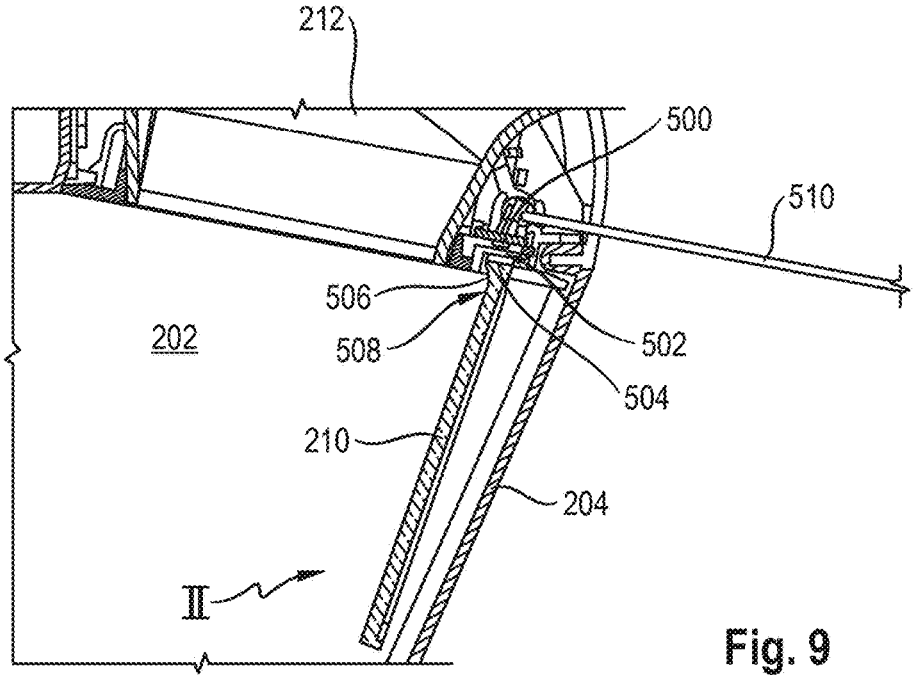
FIG. 9 shows a further cross-sectional diagram with an actuating lever in a second position.

FIGS. 8 and 9 show the actuating lever in the first position I (see FIG. 8) and in the second position II (see FIG. 9), which both involve end positions which the actuating lever 210 can assume. In the first position I the actuating lever 210 is in its unactuated state, i.e. water ice cubes and/or crushed ice are not being dispensed by the ice dispenser 112 while, in its second position II the actuating lever 210 is in the actuated state, which results in water ice cubes and/or crushed ice being dispensed by the ice dispenser 112.

In these cases it is insured by the design of the light-coupling surface 504 described above that in the first position I and in the second position II the degree of coupling-in of the light emitted by the light source 500 is equal in size. In this case "equal in size" is understood as the degree of coupling-in in the first position I and in the second position II leading to light exiting from the light exit surface 412, of which the difference in brightness lies below the limit of perception of a user, so that for a user the light exit surface 412 appears equally bright both in the first position I and in the second position II.

It goes without saying that these embodiments also apply to an actuating lever 310 of the water dispenser 114. Thus the ice dispenser 112 and the water dispenser 114 can be harmonized with one another in their optical appearance for a user, so that a refrigeration device ensemble with first refrigeration device 102 with the ice dispenser 112 and the second refrigeration device 104 with the water dispenser 114 have an optically attractive appearance through a harmonized distribution of light.

LIST OF REFERENCE CHARACTERS

100 Refrigeration device ensemble
102 First refrigeration device
104 Second refrigeration device
106 Freezer door
108 Refrigerator door
110 Refrigeration device front side
112 Ice dispenser
114 Water dispenser
200 Ice dispenser housing
202 Side wall
204 Rear wall
206 Roof
208 Floor
210 Actuating lever
212 Ice dispenser opening
214 Collection dish
216 Cover
218 Gap
300 Water dispenser housing
302 Side wall
304 Rear wall
306 Roof
308 Floor
310 Actuating lever
312 Water dispenser opening
314 Collection dish
316 Cover
318 Gap
400 Front side
402 Rear side
404 Edge
406 Side surface
408 Curved section
410 Lower connection section
412 Light exit surface
414 Symbol
416 Total reflection surface
500 Light source
502 Air gap
504 Light-coupling surface
506 Upper connection section
508 Prism section
510 Electrical line
I First position
II Second position
A Light-emitting direction
S Hinge axis
X Refrigeration device width direction
Y Refrigeration device depth direction
Z Refrigeration device height direction

The invention claimed is:

1. A refrigeration device, comprising: an ice dispenser or a water dispenser having a light source with a light-emitting direction and an actuating lever being hinged between a first position and a second position, said actuating lever having a prism section with an upper surface, said upper surface being a light-coupling surface constructed to set a degree of coupling-in of light emitted from said light source to be of equal size in said first position and in said second position; said light source being spaced apart at a distance from said light-coupling surface in said light-emitting direction by an air gap.

2. The refrigeration device according to claim 1, wherein said light source is disposed at a fixed location.

3. The refrigeration device according to claim 1, wherein said prism section and said actuating lever are constructed in one piece.

4. The refrigeration device according to claim 1, wherein said prism section and said actuating lever are constructed from a uniform material.

5. The refrigeration device according to claim 1, wherein said actuating lever has an edge with at least two side surfaces, a lower connection section and an upper connection section, said upper connection section forming said light-coupling surface.

6. The refrigeration device according to claim 5, wherein said actuating lever has curved sections each provided between a respective one of said side surfaces and said lower connection section.

7. The refrigeration device according to claim 1, wherein said prism section tapers.

8. The refrigeration device according to claim 1, wherein said actuating lever has a light exit surface.

9. The refrigeration device according to claim 8, wherein said light exit surface is a partly circumferential edge of said actuating lever.

10. The refrigeration device according to claim 8, wherein said actuating lever has at least one of a front side or a rear side constructed as a total reflection surface.

11. The refrigeration device according to claim 8, wherein said actuating lever has at least one of a front side or a rear side constructed as said light exit surface.

12. A refrigeration device ensemble, comprising: first and second refrigeration devices, said first refrigeration device having an ice dispenser and said second refrigeration device having a water dispenser; at least one of said dispensers having a light source with a light-emitting direction and an actuating lever being hinged between a first position and a second position, said actuating lever having a prism section with an upper surface, said upper surface being a light-coupling surface constructed to set a degree of coupling-in of light emitted from said light source to be of equal size in said first position and in said second position; and said light source being spaced apart at a distance from said light-coupling surface in said light-emitting direction by an air gap.

* * * * *